US007194939B2

(12) United States Patent
Chang

(10) Patent No.: US 7,194,939 B2
(45) Date of Patent: Mar. 27, 2007

(54) PNEUMATIC WRENCH HAVING REINFORCED STRENGTH

(76) Inventor: Hsin Ho Chang, No. 283, Guangfu Rd., Situn District, Taichung City (TW) 407

( * ) Notice: Subject to any disclaimer, the term of this patent is extended or adjusted under 35 U.S.C. 154(b) by 0 days.

(21) Appl. No.: 11/139,385

(22) Filed: May 27, 2005

(65) Prior Publication Data

US 2006/0266169 A1 Nov. 30, 2006

(51) Int. Cl.
*B25B 19/00* (2006.01)

(52) U.S. Cl. ..... 81/466; 81/463; 81/464; 81/465; 81/54; 173/93.5; 173/93

(58) Field of Classification Search ..... 81/466, 81/54, 464, 465, 463; 173/93, 93.5, 109
See application file for complete search history.

(56) References Cited

U.S. PATENT DOCUMENTS 2,439,756 A * 4/1948 Shaff ..... 173/93.5
2,463,656 A * 3/1949 Thomas ..... 173/93.5
3,533,479 A * 10/1970 Albertson et al. ..... 173/93.5
3,848,680 A * 11/1974 Legler ..... 173/93.5
5,740,892 A * 4/1998 Huang ..... 192/43.1
5,954,141 A * 9/1999 Li et al. ..... 173/93.5
6,024,180 A * 2/2000 Lin ..... 173/93.5
6,119,794 A * 9/2000 Chen ..... 173/93
6,186,247 B1 * 2/2001 Wang ..... 173/93.5
6,648,080 B1 * 11/2003 Liao ..... 173/93.5

* cited by examiner

*Primary Examiner*—Joseph J. Hail, III
*Assistant Examiner*—Robert Scruggs
(74) *Attorney, Agent, or Firm*—Banger Shia

(57) ABSTRACT

A pneumatic wrench includes a pneumatic motor, a striking mechanism, and a drive shaft. The striking mechanism includes a support seat, a cam, a cover, and a hammer. Thus, the pivot shaft of the hammer has two opposite sides each formed with a reinforcing rib to reinforce the structural strength of the hammer. In addition, each of the first pivot shaft and the second pivot shaft has a guide groove to overcome the shear stress applied on the hammer during the rotation striking process of the hammer, thereby preventing the hammer from being distorted or broken due to concentration of a stress so as to enhance the lifetime of the hammer.

15 Claims, 7 Drawing Sheets

PNEUMATIC WRENCH HAVING REINFORCED STRENGTH

BACKGROUND OF THE INVENTION

1. Field of the Invention

The present invention relates to a pneumatic wrench, and more particularly to a pneumatic wrench having a reinforced structural strength to withstand a larger torque.

2. Description of the Related Art

A conventional pneumatic wrench in accordance with the prior art shown in FIGS. 7–10 comprises a pneumatic motor (not shown), a striking mechanism 10, and a drive shaft 20. The drive shaft 20 is mounted on a socket (not shown), the striking mechanism 10 is mounted on the drive shaft 20, and the pneumatic motor is mounted on the striking mechanism 10 so that the striking mechanism 10 is mounted between the pneumatic motor and the drive shaft 20. Thus, the striking mechanism 10 is driven by the pneumatic motor to rotate in the normal direction and the reverse direction to drive the drive shaft 20 to rotate, so that the drive shaft 20 is driven to rotate the socket mounted on the drive shaft 20 so as to drive and rotate a screw member, such as a bolt, nut or the like.

The striking mechanism 10 includes a cylindrical support seat 11 having a closed first end face and an open second end face, a cam 15 rotatably mounted on the first end face of the support seat 11 and engaged with and rotated by the pneumatic motor, a cover 18 mounted on the second end face of the support seat 11, and a substantially arc-shaped hammer 16 rotatably mounted in the support seat 11 and engaged with the cam 15 so that the hammer 16 is driven by the cam 15 to rotate in the support seat 11. The hammer 16 has a side face having a mediate portion formed with an axially extended protruding pivot shaft 17 pivotally mounted in the support seat 11. The pivot shaft 17 of the hammer 16 has a first end formed with a first pivot shaft 170 pivotally mounted in the first end face of the support seat 11 and a second end formed with a second pivot shaft 172 pivotally mounted in the cover 18. The first end face of the support seat 11 has a central portion formed with a shaft hole 12 for mounting the cam 15. The support seat 11 has an inner wall formed with an axially extended pivot slot 13 for mounting the pivot shaft 17 of the hammer 16. The first end face of the support seat 11 has a periphery formed with a pivot hole 14 communicating with the pivot slot 13 for mounting the first pivot shaft 170. The cover 18 has an end face having a periphery formed with a pivot hole 19 for mounting the second pivot shaft 172. The drive shaft 20 has a first end formed with an engaging portion 25 engaged with the hammer 16 and a second end formed with a mounting section 22 for mounting the socket. The engaging portion 25 of the drive shaft 20 is formed with a driven groove 26 engaged with and driven by the hammer 16 so as to produce a striking effect on the drive shaft 20 by rotation of the hammer 16.

In operation, after the compressed air enters the pneumatic motor, the pneumatic motor is operated to rotate the cam 15 which engages the hammer 16 so that the hammer 16 is driven by the cam 15 to pivot in the support seat 11. Thus, the hammer 16 is pivoted to strike the drive shaft 20, and the hammer 16 strikes the drive shaft 20 once when the hammer 16 is rotated through a circle, so that the drive shaft 20 is driven to rotate the socket mounted on the mounting portion 22 of the drive shaft 20 so as to drive and rotate a screw member, such as a bolt, nut or the like.

However, the hammer 16 is substantially arc-shaped so that most of the stress of the hammer 16 is concentrated on the two opposite sides 160 of the hammer 16 during operation of the hammer 16, so that the hammer 16 is easily distorted or broken during a long-term utilization, thereby decreasing the lifetime of the hammer 16. In addition, the first pivot shaft 170 is pivotally mounted in the pivot hole 14 of the support seat 11, and the second pivot shaft 172 is pivotally mounted in the pivot hole 19 of the cover 18 so that the first pivot shaft 170 and the second pivot shaft 172 are subjected to a shear stress to produce concentration of a stress, thereby deforming or breaking the hammer 16 during the striking process.

SUMMARY OF THE INVENTION

The primary objective of the present invention is to provide a pneumatic wrench having a reinforced structural strength to withstand a larger torque.

Another objective of the present invention is to provide a pneumatic wrench, wherein the pivot shaft of the hammer has two opposite sides each formed with a reinforcing rib to reinforce the structural strength of the hammer.

A further objective of the present invention is to provide a pneumatic wrench, wherein each of the first pivot shaft and the second pivot shaft has a periphery formed with a substantially arc-shaped guide groove to overcome the shear stress applied on the hammer during the rotation striking process of the hammer, thereby preventing the hammer from being distorted or broken due to concentration of a stress so as to enhance the lifetime of the hammer.

In accordance with the present invention, there is provided a pneumatic wrench, comprising:

a striking mechanism including a cylindrical support seat having a closed first end face and an open second end face, a cam rotatably mounted on the first end face of the support seat, a cover mounted on the second end face of the support seat, and a hammer rotatably mounted in the support seat and engaged with the cam so that the hammer is driven by the cam to rotate in the support seat, wherein the hammer has a side face having a mediate portion formed with an axially extended protruding pivot shaft pivotally mounted in the support seat;

the pivot shaft of the hammer has two opposite sides each formed with a protruding reinforcing rib to reinforce the structural strength of the hammer.

Further benefits and advantages of the present invention will become apparent after a careful reading of the detailed description with appropriate reference to the accompanying drawings.

DETAILED DESCRIPTION OF THE INVENTION

Figure 1:
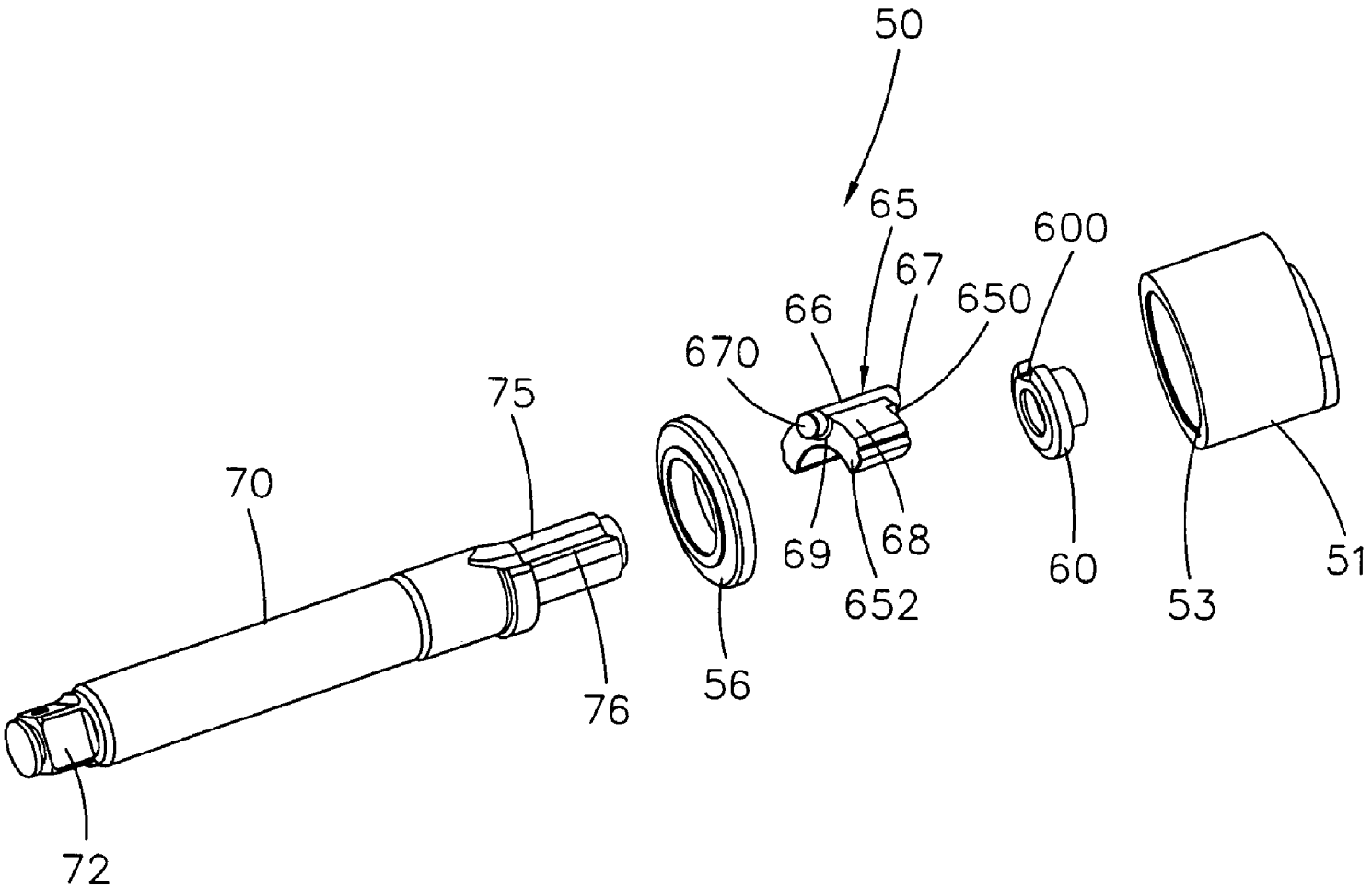
FIG. 1 is an exploded perspective view of a pneumatic wrench in accordance with the preferred embodiment of the present invention.
Figure 2:
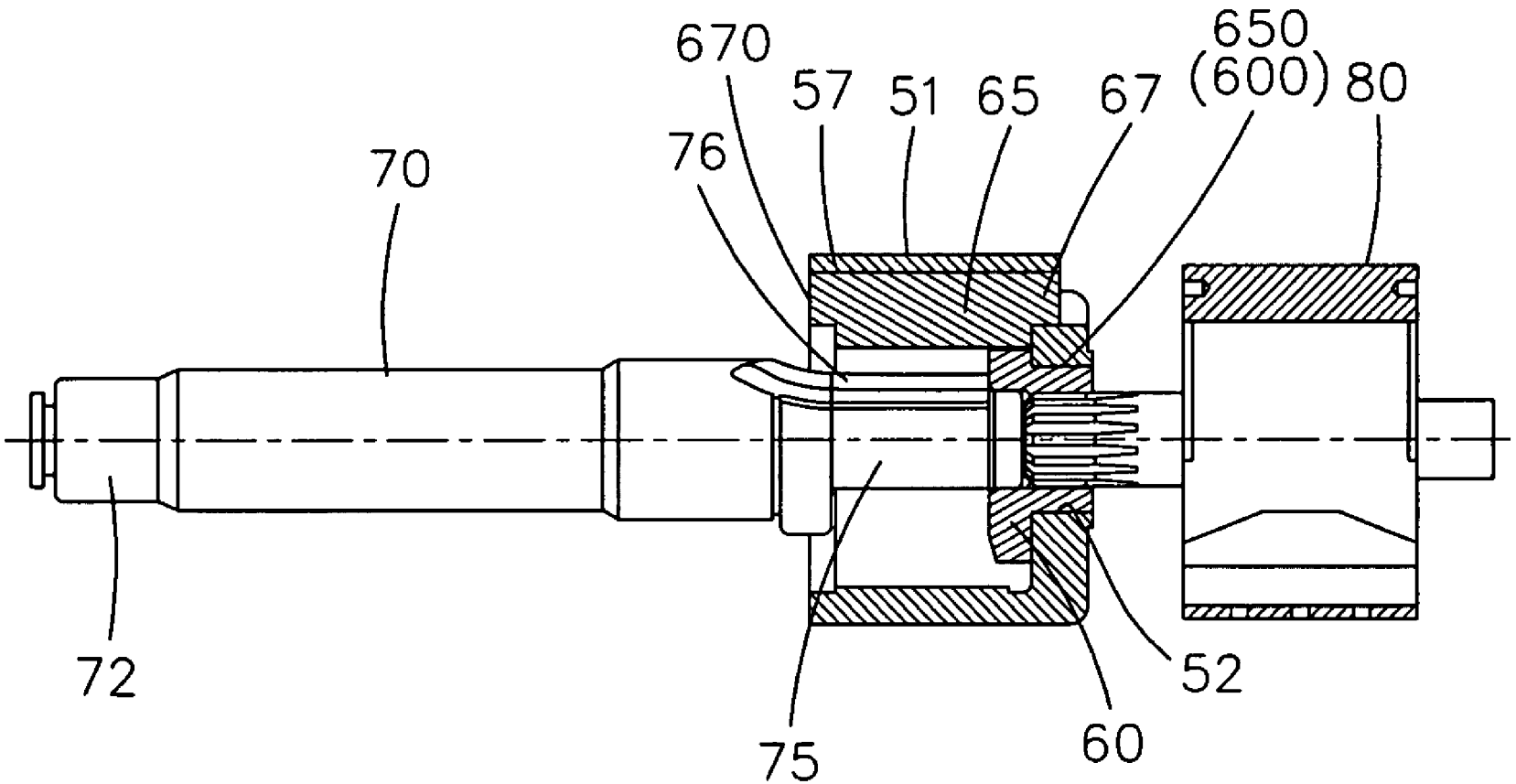
FIG. 2 is a plan cross-sectional assembly view of the pneumatic wrench as shown in FIG. 1.
Figure 4:
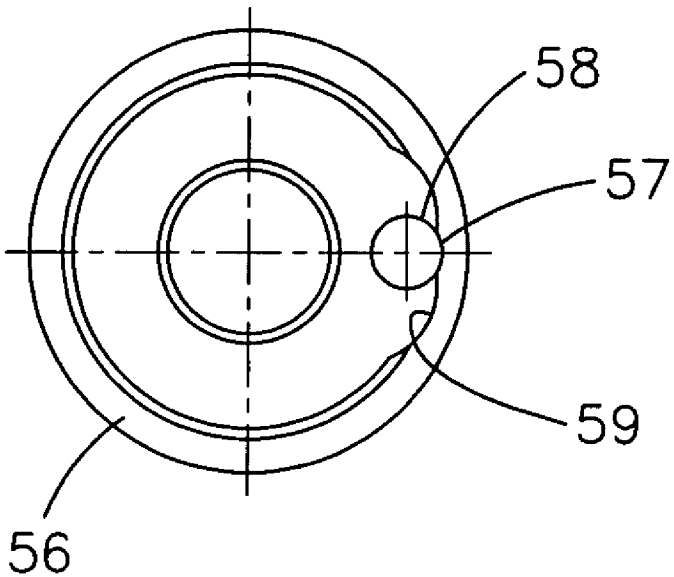
FIG. 4 is a locally enlarged plan view of a cover of the pneumatic wrench as shown in FIG. 1.
Figure 3:
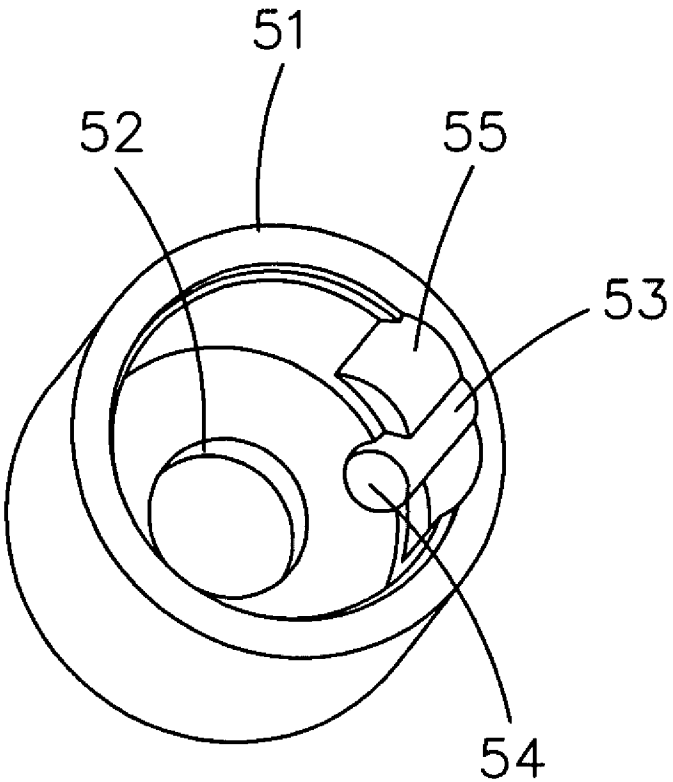
FIG. 3 is a locally enlarged perspective view of a support seat of the pneumatic wrench as shown in FIG. 1.
Figure 6:
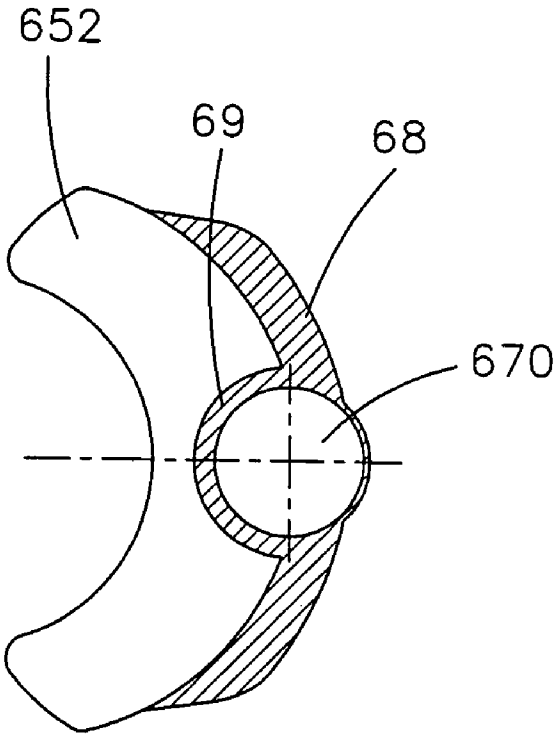
FIG. 6 is a plan cross-sectional view of the hammer of the pneumatic wrench as shown in FIG. 5.
Figure 5:
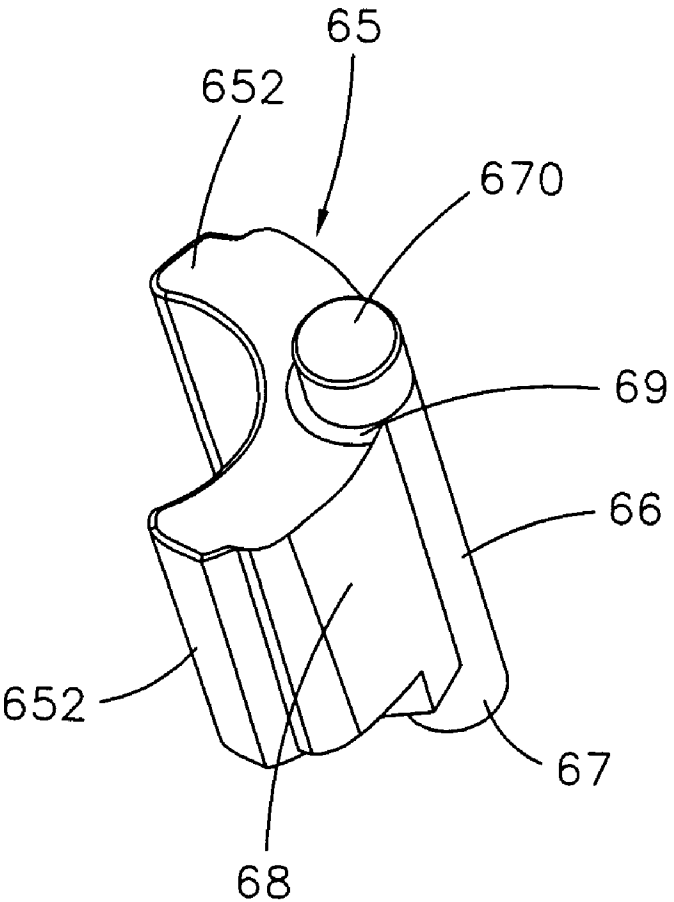
FIG. 5 is a locally enlarged perspective view of a hammer of the pneumatic wrench as shown in FIG. 1.
Figure 7:
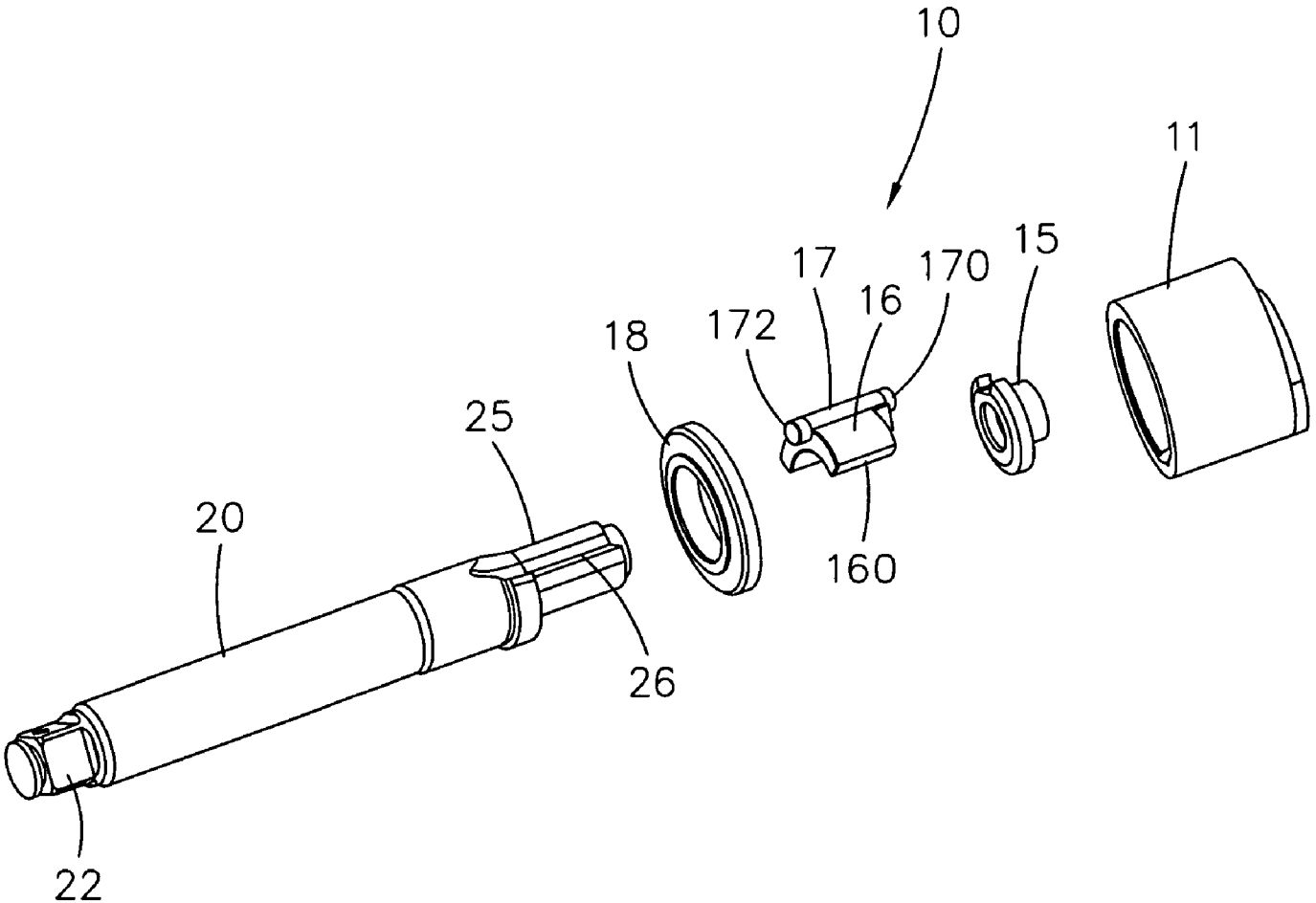
FIG. 7 PRIOR ART
FIG. 7 is an exploded perspective view of a conventional pneumatic wrench in accordance with the prior art.
Figure 9:
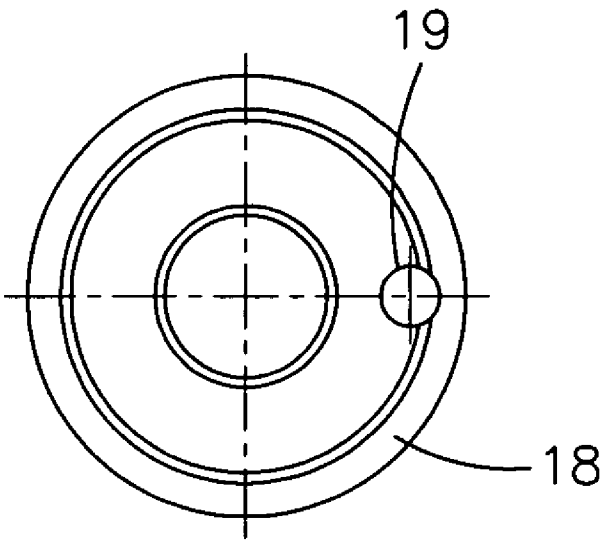
FIG.9 PRIOR ART
FIG. 9 is a locally enlarged plan view of a cover of the conventional pneumatic wrench as shown in FIG. 7.
Figure 8:
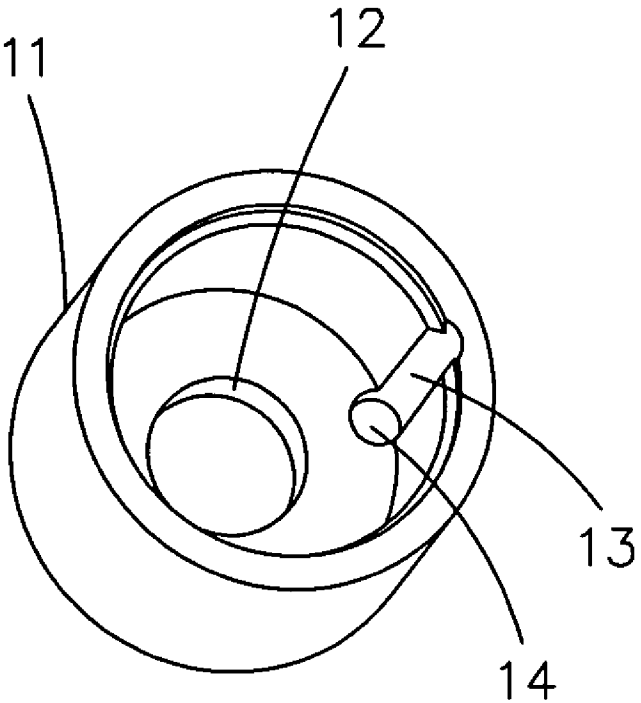
FIG.8 PRIOR ART
FIG. 8 is a locally enlarged perspective view of a support seat of the conventional pneumatic wrench as shown in FIG. 7.
Figure 10:
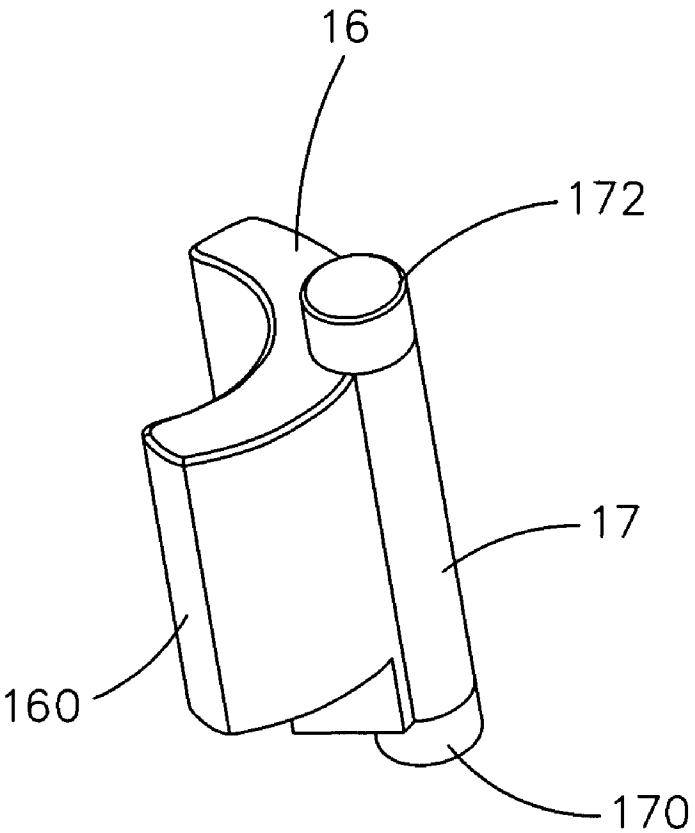
FIG. 10 PRIOR ART
FIG. 10 is a locally enlarged perspective view of a hammer of the conventional pneumatic wrench as shown in FIG. 7.

Referring to the drawings and initially to FIGS. 1 and 2, a pneumatic wrench in accordance with the preferred embodiment of the present invention comprises a pneumatic motor 80, a striking mechanism 50, and a drive shaft 70. The drive shaft 70 is mounted on a socket (not shown), the striking mechanism 50 is mounted on the drive shaft 70, and the pneumatic motor 80 is mounted on the striking mechanism 50 so that the striking mechanism 50 is mounted between the pneumatic motor 80 and the drive shaft 70. Thus, the striking mechanism 50 is driven by the pneumatic motor 80 to rotate in the normal direction and the reverse direction to drive and rotate the drive shaft 70, so that the drive shaft 70 is driven to rotate the socket mounted on the drive shaft 70 so as to drive and rotate a screw member, such as a bolt, nut or the like.

The striking mechanism 50 includes a cylindrical support seat 51 having a closed first end face and an open second end face, a cam 60 rotatably mounted on the first end face of the support seat 51 and engaged with and rotated by the pneumatic motor 80, a cover 56 mounted on the second end face of the support seat 51, and a substantially arc-shaped hammer 65 rotatably mounted in the support seat 51 and engaged with the cam 60 so that the hammer 65 is driven by the cam 60 to rotate in the support seat 51.

Referring to FIGS. 1–6, the cam 60 has a periphery formed with an engaging recess 600. The hammer 65 has an end portion formed with a protruding engaging portion 650 engaged in and driven by the engaging recess 600 of the cam 60 so that the hammer 65 is driven by the cam 60 to rotate in the support seat 51. The hammer 65 has a side face having a mediate portion formed with an axially extended protruding pivot shaft 66 pivotally mounted in the support seat 51. The pivot shaft 66 of the hammer 65 has two opposite sides each formed with a substantially arc-shaped protruding reinforcing rib 68 to reinforce the structural strength of the hammer 65. The reinforcing ribs 68 of the two opposite sides of the pivot shaft 66 are extended toward two opposite sides 652 of the hammer 65. The pivot shaft 66 of the hammer 65 has a first end formed with a first pivot shaft 67 pivotally mounted in the first end face of the support seat 51 and a second end formed with a second pivot shaft 670 pivotally mounted in the cover 56. Each of the first pivot shaft 67 and the second pivot shaft 670 is protruded outward from the hammer 65 and has a periphery formed with a substantially arc-shaped guide groove 69 located adjacent to an end face of the hammer 65.

The first end face of the support seat 51 has a central portion formed with a shaft hole 52 for mounting the cam 60. The support seat 51 has an inner wall formed with an axially extended pivot slot 53 for mounting the pivot shaft 66 of the hammer 65. The pivot slot 53 of the support seat 51 has two opposite sides each formed with a substantially arc-shaped receiving recess 55 to receive the respective reinforcing rib 68 of the pivot shaft 66. The first end face of the support seat 51 has a periphery formed with a pivot hole 54 communicating with the pivot slot 53 of the support seat 51 for mounting the first pivot shaft 67.

The cover 56 has an inner wall formed with an axially extended pivot slot 57 for mounting the pivot shaft 66 of the hammer 65. The pivot slot 57 of the cover 56 has two opposite sides each formed with a substantially arc-shaped receiving recess 59 to receive the respective reinforcing rib 68 of the pivot shaft 66. The cover 56 has an end face having a periphery formed with a pivot hole 58 communicating with the pivot slot 57 of the cover 56 for mounting the second pivot shaft 670.

The drive shaft 70 has a first end formed with an engaging portion 75 engaged with the hammer 65 and a second end formed with a mounting section 72 for mounting the socket. The engaging portion 75 of the drive shaft 70 is formed with a driven groove 76 engaged with and driven by the hammer 65 so as to produce a striking effect on the drive shaft 70 by rotation of the hammer 65.

In operation, after the compressed air enters the pneumatic motor 80, the pneumatic motor 80 is operated to rotate the cam 60 which engages the hammer 65 so that the hammer 65 is driven by the cam 60 to pivot in the support seat 51. Thus, the hammer 65 is pivoted to strike the drive shaft 70, and the hammer 65 strikes the drive shaft 70 once when the hammer 65 is rotated through a circle, so that the drive shaft 70 is driven to rotate the socket mounted on the mounting portion 72 of the drive shaft 70 so as to drive and rotate a screw member, such as a bolt, nut or the like.

Accordingly, the pivot shaft 66 of the hammer 65 has two opposite sides each formed with a reinforcing rib 68 to reinforce the structural strength of the hammer 65. In addition, each of the first pivot shaft 67 and the second pivot shaft 670 has a periphery formed with a substantially arc-shaped guide groove 69 to overcome the shear stress applied on the hammer 65 during the rotation striking process of the hammer 65, thereby preventing the hammer 65 from being distorted or broken due to concentration of a stress so as to enhance the lifetime of the hammer 65.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pneumatic wrench, comprising:

a striking mechanism including a cylindrical support seat having a closed first end face and an open second end face, a cam rotatably mounted on the first end face of the support seat, a cover mounted on the second end face of the support seat, and a hammer rotatably mounted in the support seat and engaged with the cam so that the hammer is driven by the cam to rotate in the support seat, wherein the hammer has a side face having a mediate portion formed with an axially extended protruding pivot shaft pivotally mounted in the support seat;

the pivot shaft of the hammer has two opposite sides each formed with a protruding reinforcing rib to reinforce the structural strength of the hammer;

the pivot shaft of the hammer has a first end formed with a first pivot shaft pivotally mounted in the first end face of the support seat and a second end formed with a second pivot shaft pivotally mounted in the cover;

the support seat has an inner wall formed with an axially extended pivot slot for mounting the pivot shaft of the hammer;

the pivot slot of the support seat has two opposite sides each formed with a receiving recess to receive the respective reinforcing rib of the pivot shaft.

2. The pneumatic wrench in accordance with claim 1, wherein the reinforcing rib of each of the two opposite sides of the pivot shaft is substantially arc-shaped.

3. The pneumatic wrench in accordance with claim 1, wherein the reinforcing ribs of the two opposite sides of the pivot shaft are extended toward two opposite sides of the hammer.

4. The pneumatic wrench in accordance with claim 1, wherein the hammer is substantially arc-shaped.

5. The pneumatic wrench in accordance with claim 1, wherein the cam has a periphery formed with an engaging recess, and the hammer has an end portion formed with a protruding engaging portion engaged in and driven by the engaging recess of the cam so that the hammer is driven by the cam to rotate in the support seat.

6. The pneumatic wrench in accordance with claim 1, wherein each of the first pivot shaft and the second pivot shaft is protruded outward from the hammer.

7. The pneumatic wrench in accordance with claim 1, wherein each of the first pivot shaft and the second pivot shaft has a periphery formed with a guide groove located adjacent to an end face of the hammer.

8. The pneumatic wrench in accordance with claim 7, wherein the guide groove is substantially arc-shaped.

9. The pneumatic wrench in accordance with claim 1, wherein the receiving recess of the support seat is substantially arc-shaped.

10. The pneumatic wrench in accordance with claim 1, wherein the first end face of the support seat has a periphery formed with a pivot hole communicating with the pivot slot of the support seat for mounting the first pivot shaft.

11. The pneumatic wrench in accordance with claim 1, wherein the first end face of the support seat has a central portion formed with a shaft hole for mounting the cam.

12. The pneumatic wrench in accordance with claim 1, wherein the cover has an inner wall formed with an axially extended pivot slot for mounting the pivot shaft of the hammer.

13. The pneumatic wrench in accordance with claim 12, wherein the cover has an end face having a periphery formed with a pivot hole communicating with the pivot slot of the cover for mounting the second pivot shaft.

14. The pneumatic wrench in accordance with claim 12, wherein the pivot slot of the cover has two opposite sides each formed with a receiving recess to receive the respective reinforcing rib of the pivot shaft.

15. The pneumatic wrench in accordance with claim 14, wherein the receiving recess of the cover is substantially arc-shaped.

* * * * *